United States Patent [19]

Pollock

[11] Patent Number: 4,522,444

[45] Date of Patent: Jun. 11, 1985

[54] STACKING CHAIR

[76] Inventor: Charles Pollock, 34-24 86th St., Jackson Heights, N.Y. 11372

[21] Appl. No.: 418,510

[22] Filed: Sep. 15, 1982

[51] Int. Cl.[3] ..... A47C 3/04

[52] U.S. Cl. ..... 297/239; 297/288; 297/440

[58] Field of Search ..... 297/239, 295, 294, 286, 297/287, 288, 457, 440

[56] References Cited

U.S. PATENT DOCUMENTS

| | | | |
|---|---|---|---|
| D. 102,099 | 11/1936 | Wexelblatt | 297/288 X |
| 1,978,024 | 10/1934 | Lorenz | 297/288 |
| 2,085,804 | 7/1937 | Heimann | 297/288 |
| 2,557,671 | 6/1951 | McDonald | 297/287 |
| 2,638,149 | 5/1953 | Janosek | 297/287 X |
| 3,709,559 | 1/1973 | Rowland | 297/457 |
| 4,062,590 | 12/1977 | Polsky et al. | 297/457 |
| 4,097,089 | 6/1978 | Petersen | 297/440 |

FOREIGN PATENT DOCUMENTS

| | | | |
|---|---|---|---|
| 201938 | 11/1955 | Australia | 297/288 |
| 946197 | 12/1948 | France | 297/287 |

*Primary Examiner*—Francis K. Zugel

*Attorney, Agent, or Firm*—Kane, Dalsimer, Kane, Sullivan & Kurucz

[57] ABSTRACT

An occasional chair is provided with two Z-shaped sides, two cross-members, and a seat comprising a rim and a mesh. The mesh allows for ventilation and the Z-shaped sides make the chair flexible. A plurality of these chairs can be stacked for easy storage.

7 Claims, 5 Drawing Figures

STACKING CHAIR

BACKGROUND OF THE INVENTION

Chairs for occasional use have been devised over the years. Many of such chairs were foldable so that they could be stored easily when they were not in use. Foldable chairs however are generally complicated, expensive and uncomfortable. Many a user has found difficulty in folding and unfolding such chairs. For foldability relatively movable parts increase cost and since the primary objective is to fold the chair, the comfort of the potential user is completely overlooked. Recently stackable chairs have come into use which are less complicated and more comfortable but these are generally quite expensive.

OBJECTIVES AND SUMMARY OF THE INVENTION

This invention provides a stackable chair which is comfortable to use and is decorative while being durable and relatively economical to produce. The ergonomical action of the base combined with the flexibility of the mesh of the sculptured seat establishes a spring action. The occupant of the chair obtains the impression that he is on a cushion with a restrained floating action.

The stacking chair of this invention is multi-purpose for outdoor or indoor use and can be fitted with accessories such as pads, ashtrays and a writing arm for example. The chair can be made decorative. Production is uncomplicated. No tooling is required and the parts can be formed from tubular stock bent on a standardized bending jig.

A chair made in accordance with the present invention comprises: a base having two sides, each of which has a main Z-shaped body which ends in two stubs which are oriented generally perpendicular to the plane of the Z-shaped body, front and rear cross members constructed and arranged to engage respective stubs of the Z-shaped body to join the two sides; a continuous seat rim supported by the base; and a sculptured seat of malleable thin mesh having a peripheral edge engaging the rim.

For stacking, the chair is turned on its side in a "V" position and in the order of thirty chairs can be stacked in sixty inches.

DESCRIPTION OF THE PREFERRED EMBODIMENT

Figure 1:
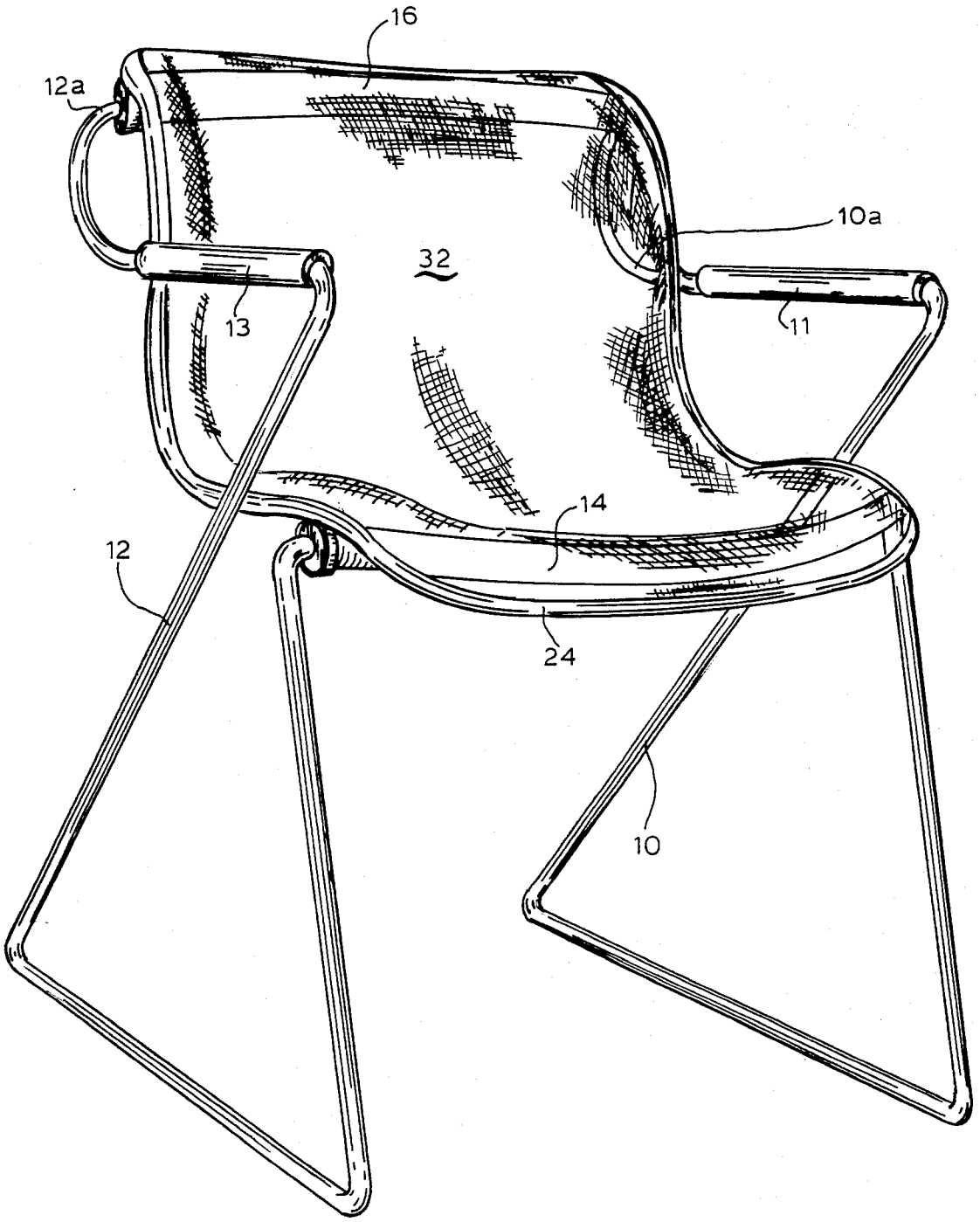
FIG. 1 is a front perspective view of a stacking chair constructed in accordance with this invention.
Figure 2:
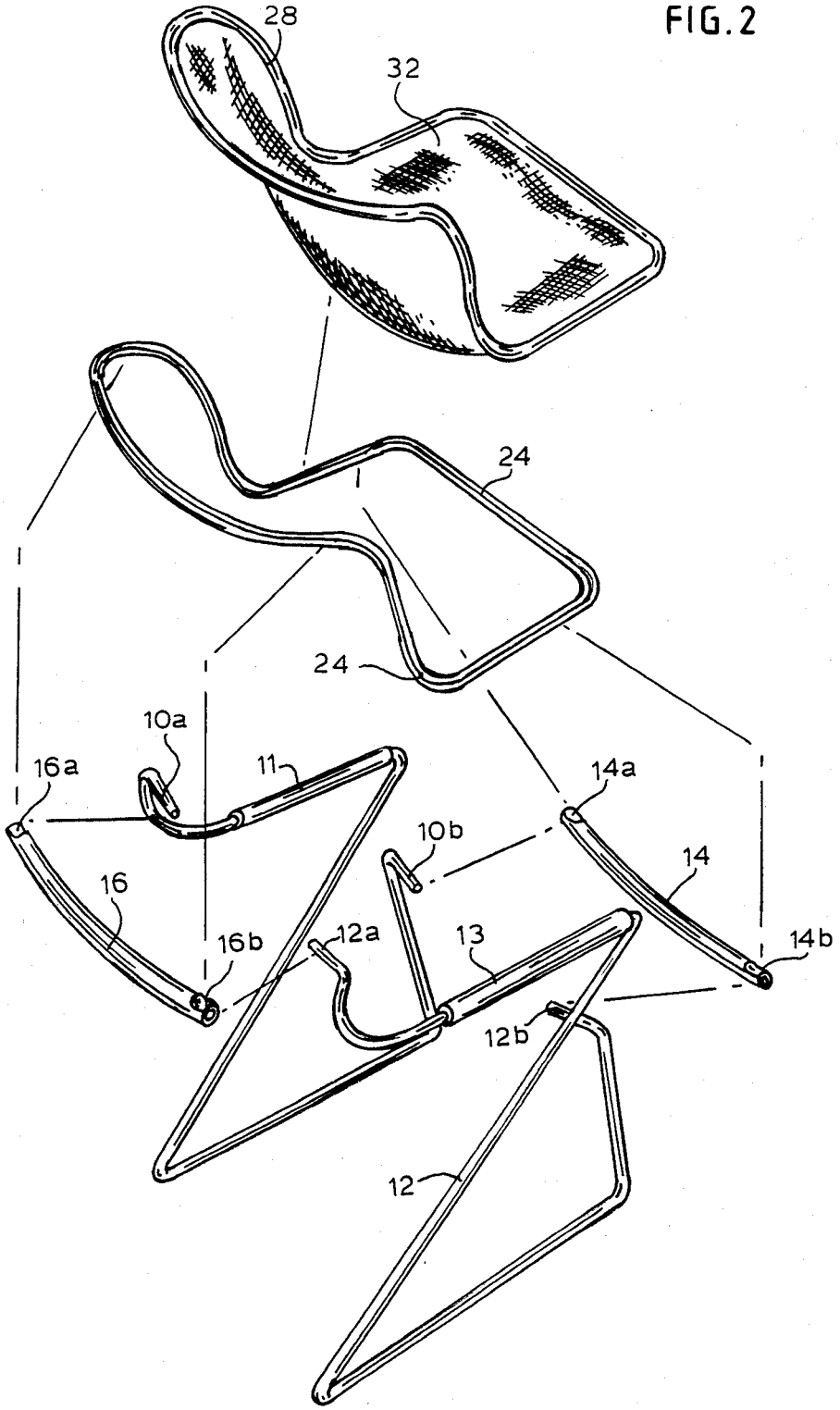
FIG. 2 is an exploded view of the chair shown in FIG. 1.

The chair of the invention as shown in the Figs. comprises a base having left and right sides 10 and 12, respectively, which are preferably made of ½ inch hardened steel tubing each of which has a main Z-shaped body which ends in two inwardly directed stubs which are oriented generally perpendicular to the plane of the Z-shaped body. In the Figs. the stubs of side 10 are indicated by the numerals 10*a* and 10*b* while the stubs of side 12 are indicated by the numerals 12*a* and 12*b*. Molded polyurethane tubings 11 and 13 are disposed in position to provide arm rests.

Front and rear cross members which in the preferred embodiment are extruded aluminum 14 and 16 respectively are constructed and arranged to engage respective stubs 10*a*, 10*b*, 12*a* and 12*b* in order to join sides 10 and 12. Thus it is seen that female ends 14*a* and 14*b* of cross member 14 engage stubs 10*b* and 12*b* respectively to provide two joints and ends 16*a* and 16*b* engage stubs 10*a* and 12*a* respectively to provide two additional joints.

The manner of joining will be described below.

Each of the cross members is covered with an elastomeric sheathing.

A continuous seat rim 24 is supported by the base at the joints.

The rim has a lip 26 which is formed with a groove 28 during the extrusion process. Also score mark 30 is formed in the frame below the groove to avoid uncontrolled surface destortion during later crimping. The mesh 32 of the seat is formed with a projecting edge 34 which is complementary to groove 28 and can be inserted therein. The mesh edge 34 is inserted in groove 28 in the direction shown in the Figs. After the mesh is in place lip 26 is crimped thus applying a restraining force on the mesh.

The rim is extruded aluminum and the mesh 32 has a sculptured shape to provide a comfortable seating. It is preferably constructed of a thin malleable steel mesh which in the preferred embodiment is coated and treated after shaping to give dimensional stability and to provide memory. (A typical process to achieve this would be that referred to in the art as a fluid bed coating process).

Figures 3, 4:
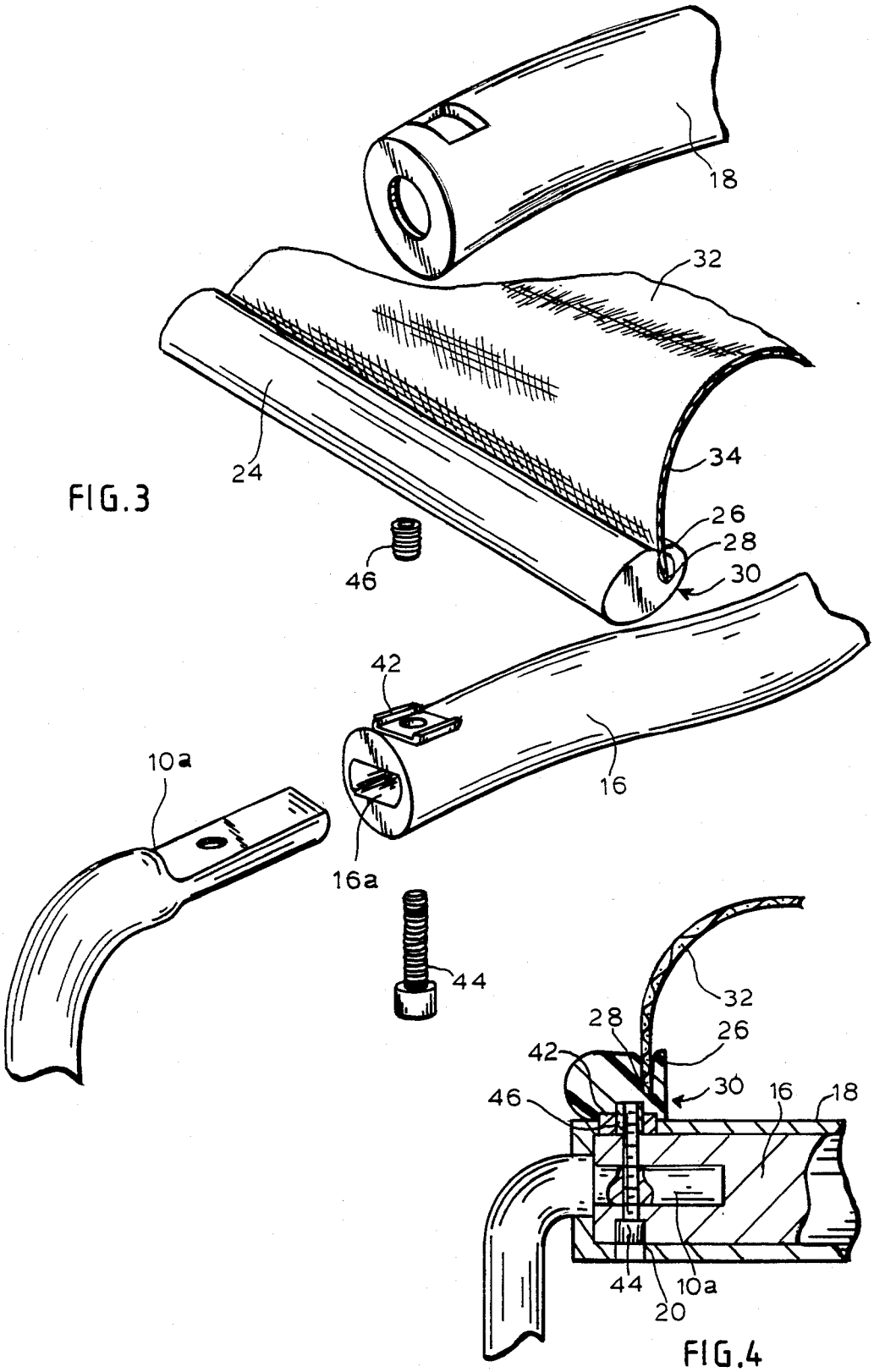
FIG. 3 is a segmentary exploded view of one of the four joints for assembly.
FIG. 4 is a sectional view further illustrating the joint shown in FIG. 3.

One of the joints is illustrated in detail in FIGS. 3 and 4 where stub 10*a* is shown joining end 16*a*. The joint shown is illustrative since the remaining four joints are the same. As seen stub 10*a* is received within the opening of 16*a*. Cross member 16 is shown covered by elastomeric sheath 18. Openings are formed in stub 10*a*, end 16*a* and the sheath to allow passage of bolt 20 therethrough. It is noted that the female openings are rectangular as are the stubs so that engagement is effected in a manner to resist relative rotation and transfer the torque through the steel frame. A clip 42 is provided for stability and the end of the bolt 44 engages insert 46 which is threaded internally and externally so as to enable the bolt to be engaged to the rim.

Figure 5:
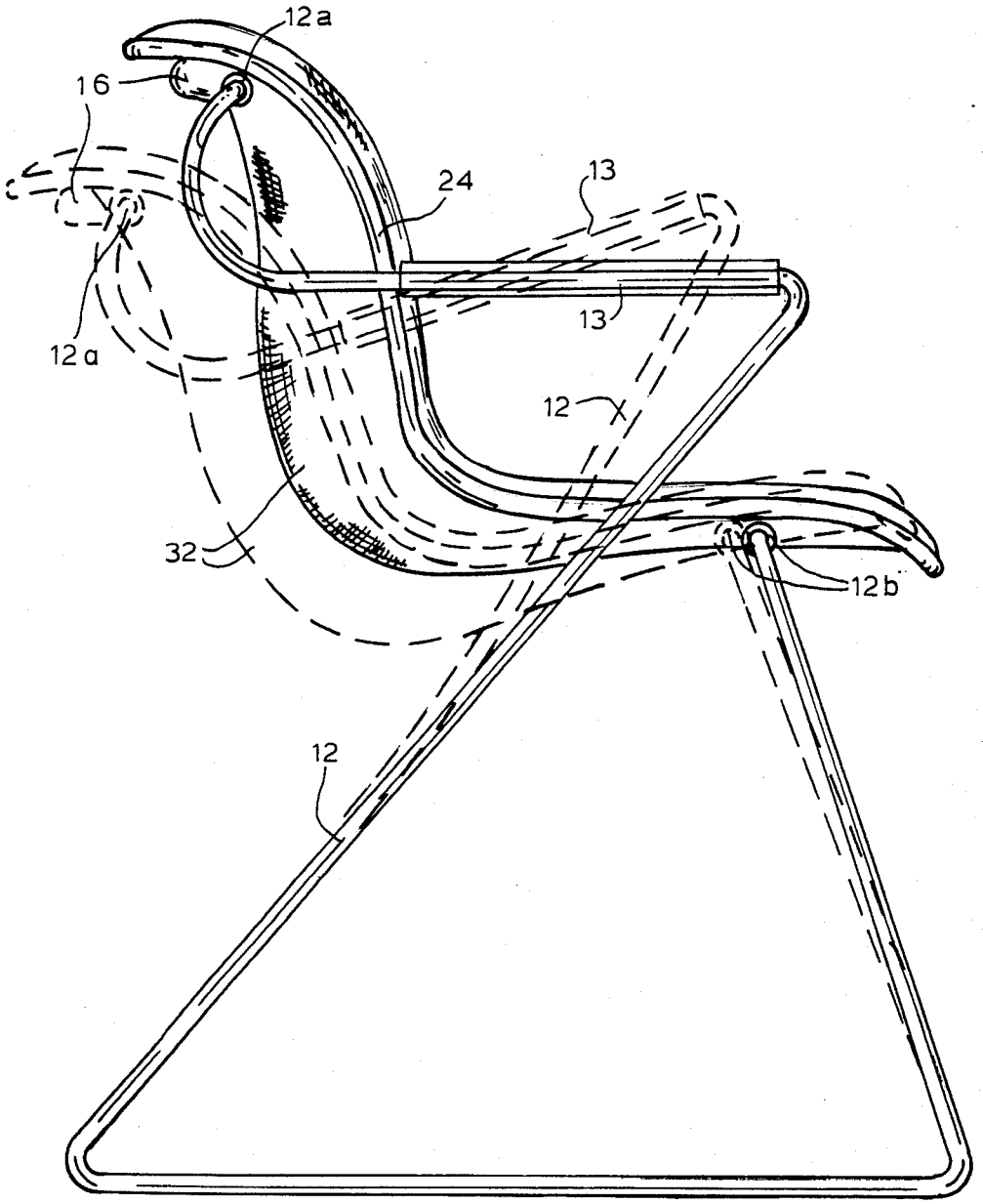
FIG. 5 is a side-view of the chair with a second view shown in phantom superimposed thereon to illustrate its flex capabilities.

The resultant chair is flexible. This flexibility makes the chair very comfortable. FIG. 5 illustrates two different configurations that the chair could take while a person is sitting in it. The solid lines show its stable position while the dotted lines show two dynamic configurations.

The chairs are stacked by turning each chair on its side and nestling them together, preferrably on a V-shaped platform. Thirty such stacked chairs need only sixty inches of storage space. Furthermore, since during the stacking only the rubber portions come in contact with each other the whole operation is fairly quiet.

The components and physical characteristics of the chair such as the mesh which allows ventilation and the tubular frame and sides which contribute to its lightness and flexibility are combined to create an ergonomical product. Furthermore, the components are made out of standard stock items and are shaped by using standard and economical methods. Thus the chair is not only attractive, practical and comfortable but it is also inexpensive to produce.

It is evident that various modifications may be made to this invention which is still within the scope of this invention as set forth in the appended claims.

I claim:

1. A chair comprising:

first and second side members each of said side members having a z-shaped main body with upwardly directed terminating portions, first and second ends of said first side member projecting perpendicularly thereto, third and fourth ends of said second side member projecting perpendicularly thereto, said first and third ends lying on the same axis and projecting towards each other, said second and fourth ends lying on the same axis and projecting towards each other, a first cross member lying on the axis of said first and second ends and interconnecting said first and second ends, a second cross member lying on the axis of said third and fourth ends and interconnecting said third and fourth ends, said first and second cross members being parallel with said first cross member lying in a plane above said second cross member, a contoured seat, a continuous peripheral rim of said contoured seat, and said seat supported by engagement of said rim with said first and second cross members on upper surfaces thereof.

2. The chair in claim 1 wherein said rim is an extruded member formed with a groove wherein the mesh of said seat is received.

3. The chair in claim 1 wherein each of said ends is formed with a non-circular connecting portion to be received by a non-circular connecting portion of the respective connecting member whereby rotational movement between the same is restricted.

4. The chair in claim 1 wherein the seat comprises a mesh.

5. The chair in claim 4 wherein the mesh is a contured steel mesh.

6. The chair in claim 1 wherein both the rear and the front cross-members are covered with a rubber sheathing.

7. The chair in claim 1 wherein the seat is supported by the sides by using two cross-member joints, one for each side.

* * * * *